US009541293B2

(12) United States Patent
Düsing

(10) Patent No.: US 9,541,293 B2
(45) Date of Patent: Jan. 10, 2017

(54) REHEAT BURNER AND METHOD OF MIXING FUEL/CARRIER AIR FLOW WITHIN A REHEAT BURNER

(71) Applicant: ALSTOM Technology Ltd, Baden (CH)

(72) Inventor: Michael Düsing, Rheinfelden (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 657 days.

(21) Appl. No.: 13/951,507

(22) Filed: Jul. 26, 2013

(65) Prior Publication Data

US 2014/0026586 A1 Jan. 30, 2014

(30) Foreign Application Priority Data

Jul. 30, 2012 (EP) ..... 12178470

(51) Int. Cl.

*F23R 3/34* (2006.01)
*F23C 3/00* (2006.01)
*F23R 3/20* (2006.01)

(52) U.S. Cl.

CPC ..... *F23R 3/346* (2013.01); *F23C 3/002* (2013.01); *F23R 3/20* (2013.01)

(58) Field of Classification Search

CPC ..... F23C 3/002; F23C 3/20; F23C 3/346; F02K 1/386

See application file for complete search history.

(56) References Cited

U.S. PATENT DOCUMENTS 3,625,009 A 12/1971 Schairer et al.
3,973,395 A 8/1976 Markowski et al.
4,686,826 A 8/1987 Koshoffer et al.
4,845,940 A * 7/1989 Beer ..... F23C 6/045 60/732
5,235,813 A 8/1993 McVey et al.
(Continued)

FOREIGN PATENT DOCUMENTS

CN 1117576 A 2/1996
CN 1209521 A 3/1999
(Continued)

OTHER PUBLICATIONS

Office Action issued on Aug. 5, 2015, by the State Intellectual Property Office of People's Republic China in corresponding Chinese Patent Application No. 201310324475.1, and an English Translation of the Office Action. (19 pages).

*Primary Examiner* — Carlos A Rivera
(74) *Attorney, Agent, or Firm* — Buchanan Ingersoll & Rooney PC

(57) ABSTRACT

The invention refers to a reheat burner that includes a flow channel for a hot gas flow with a lance arranged along said flow channel, protruding into the flow channel for injecting a fuel over an injection plane perpendicular to a channel longitudinal axis, wherein the channel and lance define a vortex generation zone upstream of the injection plane and a mixing zone downstream of the injection plane in the hot gas flow direction. The mixing zone provides at least one axially region having different cross sectional areas along its longitudinal axis with continuously changing shape, or having non circular cross section areas which change location along its longitudinal axis by continuously rotation around the longitudinal axis.

12 Claims, 4 Drawing Sheets

(56) References Cited

U.S. PATENT DOCUMENTS

| | | | | |
|---|---|---|---|---|
| 6,606,854 | B1 * | 8/2003 | Siefker | B63G 13/02 181/213 |
| 6,868,676 | B1 * | 3/2005 | Haynes | F02C 3/14 60/740 |
| 7,389,635 | B2 * | 6/2008 | Anderson | F02K 1/386 181/220 |
| 7,882,696 | B2 * | 2/2011 | Anderson | F01D 25/28 181/220 |
| 2005/0100846 | A1 | 5/2005 | Gutmark et al. | |
| 2010/0300109 | A1 * | 12/2010 | Carroni | F23R 3/286 60/776 |
| 2012/0036824 | A1 | 2/2012 | Buss et al. | |
| 2012/0304656 | A1 * | 12/2012 | Melton | F01D 9/023 60/752 |

FOREIGN PATENT DOCUMENTS

| | | | |
|---|---|---|---|
| CN | 102183020 | A | 9/2011 |
| DE | 103 55 930 | | 7/2004 |
| EP | 2 362 148 | | 8/2011 |
| EP | 2 420 730 | | 2/2012 |
| EP | 2 420 731 | | 2/2012 |
| RU | 2002994 | C1 | 11/1993 |
| RU | 2210023 | C2 | 8/2003 |

* cited by examiner

REHEAT BURNER AND METHOD OF MIXING FUEL/CARRIER AIR FLOW WITHIN A REHEAT BURNER

CROSS-REFERENCE TO RELATED APPLICATIONS

This application claims priority to European Application 12178470.6 filed Jul. 30, 2012, the contents of which are hereby incorporated in its entirety.

TECHNICAL FIELD

The present invention relates to the field of stationary gas turbines using sequential combustion. In the context of sequential combustion the shape of a reheat burner is of central significance in which mixing of fuel and additional carrier air takes place for the purpose of producing an auto-ignitable fuel/carrier air mixture.

BACKGROUND

Sequential combustion gas turbines are known to comprise a first burner, wherein a fuel is injected into a compressed air stream to be combusted generating hot gases that are partially expanded in a high pressure turbine.

The hot gases coming from the high pressure turbine, which are still rich in oxygen, are then fed into a reheat burner, which is commonly named as second stage combustion, wherein a further fuel is injected there into to be mixed and combusted in a combustion chamber downstream of the reheat burner; the hot gases generated are then expanded in a low pressure turbine.

The reheat burner of the sequential combustion gas turbine has a duct which is often square, quadrangular or trapezoidal in shape, enclosing static vortex generators typically made of tetraedrical elements connected to the walls in an upstream region of the duct and extending into the duct partially.

Downstream of the vortex generators the reheat burner has a lance made of a straight tubular element placed perpendicularly to the direction of the hot gases flow and provided with a terminal portion that is parallel to the direction of the hot gases flow. The terminal portion usually has more than one nozzle that injects the fuel.

During operation the hot gases flow passes through the turbulence generators, for example vortex generators, flute VG lance, flute lobes lance, by increasing its vortices; afterwards the fuel is injected through the lance such that it mixes with the hot gases flow.

Currently downstream of the lance mixing is basically enhanced by a reduction of the cross sectional area of the burner duct, which reduces the effective diameter to length ratio of the burner. In order to minimise the combustor pressure loss the cross sectional area is increased again towards the end of the mixing zone. Such a reheat burner is disclosed in EP 2 420 730 A2 for example. This cross sectional area increase at the downstream end region of the burner duct is limited by potential separation of the flow from the ducts' walls within the mixing zone. Therefore a conflict between achievable mixing quality and pressure loss exists.

Providing large scale and/or small scale structures along the mixing zone for the purpose of increasing vortices is not the means to encounter the problems due to the risk of recirculation zones and therefore flame holding inside the mixing zone. It is also exacerbated that turbulences, which were created by vortex generators and/or lances decreases constantly inside the mixing zone in flow direction. Therefore mixing does not happen as effective towards the end of the mixing zone as it does close to the injection.

Furthermore, in order to increase the gas turbine efficiency and performances, the temperature of the hot gases circulating through the reheat burner should be increased. Such a temperature increase causes the delicate equilibrium among all the parameters to be missed, such that a reheat burner operating with hot gases having a higher temperature than the design temperature may have flashback, NOx, CO emissions, water consumption and pressure drop problems.

To encounter these constraints partially a reheat burner is proposed, see EP 2 420 730 A2, having a mixing zone with a cross section of diverging side walls in the hot gas flow direction, wherein the diverging side walls define curved surfaces in the hot gas flow direction having a constant radius.

Another proposal for reducing the narrative problems is disclosed in EP 2 420 731 A1 which discloses a reheat burner providing a high speed area with a constant cross section along the mixing zone. Downstream in hot gas flow direction to the high speed area a diffusion area borders with a flared cross section.

It is known that at the downstream end of the mixing zone between the mixing zone and the combustion chamber a step in cross section has the effect of a flame holder.

SUMMARY

It is an object of the invention to provide a reheat burner comprising a flow channel for a hot gas flow with a lance arranged along said flow channel, protruding into the flow channel for injecting a fuel over an injection plane perpendicular to a channel longitudinal axis, wherein the channel and lance define a turbulence generation zone upstream of the injection plane and a mixing zone downstream of the injection plane in the hot gas flow direction, and a step in cross section of the hot gas channel between the downstream end of the mixing zone and the combustor is foreseen as a flame holder which enables operation at higher temperatures and at the same time achieving a reduction of NOx, CO emissions and lessening pressure drop problems and the risk of flashbacks. To achieve these targets it is a further object to increase the flame temperature of the second combustion and to enhance the degree of mixing of the fuel/carrier air flow.

The invention can be modified advantageously by the features disclosed in the claims as well in the following description especially referring to preferred embodiments.

To achieve enhanced mixing of the gas mixture, in the following just named as flow, passing through the mixing zone of the reheat burner it is proposed inventively to introduce additional shear stress to the flow while passing the mixing zone, whereby large scale flow structures and enhanced turbulences are created along the mixing zone. This improves the mixing performance which leads to more homogeneous temperature distribution inside the flame and therefore to reduced CO and NOx emissions and as well to a reduced overall temperature distribution factor at the inlet to a turbine stage being arranged downstream of said reheat burner.

To direct shear stress into the flow while passing through the mixing zone of the reheat burner the corresponding flow channel of the mixing zone provides different cross sectional areas in flow direction with continuously changing shape and/or provides non circular cross section areas which change location in flow direction by continuously rotation around a longitudinal axis of the flow channel.

The first proposed constructive action to form the flow channel through the mixing zone is to vary the shape of the cross sectional area of the flow channel along its longitudinal axis smoothly. Varying the shape of the cross sectional area does not mean just to enlarge or reduce a given cross sectional area shape for example to scale a circular cross sectional area along the longitudinal axis of the flow channel merely, rather it is meant inventively to vary the geometrical shape continuously. For example the mixing zone has in an upstream area a cross sectional area of square shape which will be transferred in flow direction along the extension of the mixing zone into a cross section area of circular shape. Of course the scope of the inventive idea encircles all conceivable shapes of cross sectional areas which can be modified smoothly into each other along entire axial extension or at least in one limited axially region of the mixing zone.

Another inventive action for directing additional shear stress to the flow directed through the mixing zone is to provide a flow channel along the mixing zone with at least one axially region having non circular cross section areas which change location along its longitudinal axis by continuously rotation around the longitudinal axis. Thereby a given cross section area shape of the mixing zone is kept unchanged along the axial coordinate of the mixing zone, while it gets rotated around the longitudinal axis. Rotation can be realized in clock wise or anti-clock wise direction, when moving in flow direction through the mixing zone.

As mentioned before the action of reshaping of the cross sectional area or the rotation of a given cross sectional area shape along the mixing zone each can be applied preferably along the entire extension of the mixing zone but also just in a limited axially region along the mixing zone.

Another preferred embodiment provides a combination of the two inventively proposed actions, such that the mixing zone is subdivided into at lest two axially, a first and a second, regions being connected directly or indirectly. In case of an indirect axial combination an additional intermediate zone, for example of constant cross sectional area along its axially extension, connects the at least two axially regions. In the first axial region the corresponding flow channel have different cross sectional areas along its longitudinal axis with continuously changing shape. In the second axially region the flow channel provides the noncircular cross section area shape which changes location along its longitudinal axis by continuously rotation around the longitudinal axis. The same applies vice versa.

In a further embodiment the flow channel of the mixing zone provides along its entire axially extension non circular cross section areas all having the same geometrical shape which continuously rotates around the longitudinal axis but at least a few of them differ in size. For example the cross section area at the upstream end of the mixing zone has a triangular cross section area shape in a first orientation relatively to the longitudinal axis. The downstream end of the flow channel of the mixing zone has also a triangular cross sectional area shape which however is rotated e.g. about 90° around the longitudinal axis in clock wise direction in flow direction. Further the triangular cross sectional area at the downstream end of the mixing zone is reduced in size compared to the cross section area of the upstream end of the mixing zone. So the intermediate part of the flow channel between the upstream and the downstream end of the mixing zone transfers both different orientated and sized cross sectional areas into each other smoothly.

All embodiments of the invention provide a flow channel enclosing the mixing zone radially having an inner channel wall which is smooth without any locally protrusions extending beyond the inner wall surface to avoid the risk of flash backs. The inventive modification of the flow channel within the mixing zone of the reheat burner realized either by reshaping or by rotation of the cross section areas leads to a larger spread of the hot gas mixture leaving the reheat burner which improves the inlet velocity profile into a turbine stage following the reheat burner downstream the flow channel.

The smooth reshaping of the cross sectional area within the mixing zone is further preferable coupled with a reduction of the cross sectional area in flow direction in order to avoid separation of the flow from the inner channel wall, which would lead to a risk of flame anchoring inside the mixing zone.

Furthermore an opening of the cross sectional area towards the end of the mixing zone, which means that the cross sectional areas at the downstream end region of the mixing zone getting greater in flow direction, supports to achieve a minimum pressure loss over the extension of the reheat burner.

BRIEF DESCRIPTION OF THE FIGURES

The invention shall subsequently be explained in more detail based on exemplary embodiments in conjunction with the drawing. In the drawing

DETAILED DESCRIPTION

Figure 1:
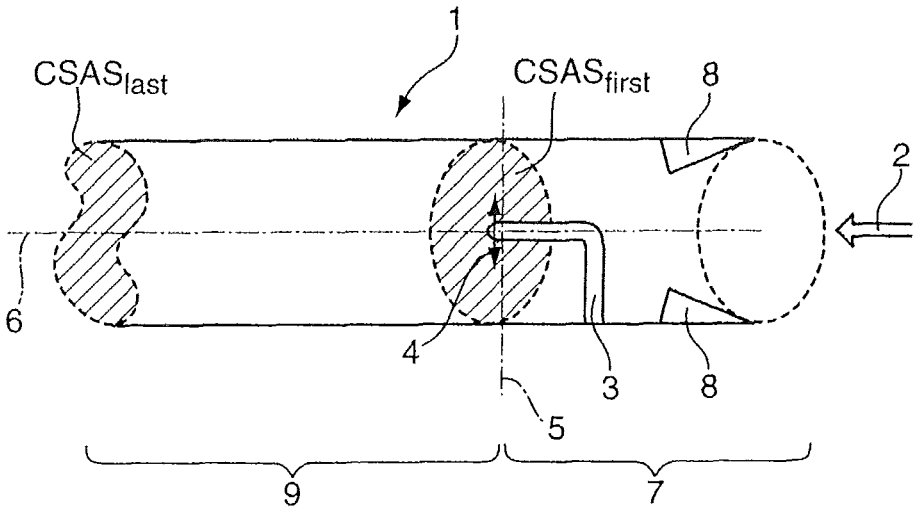
FIG. 1 shows schematically longitudinal section through a reheat burner FIG. 2*a, b, c* perspective views of the outer shape or mixing zone of a reheat burner.

FIG. 1 shows a schematically longitudinal section of a reheat burner comprising a flow channel 1 for a hot gas flow 2 with a lance 3 arranged along said flow channel 1, protruding into the flow channel 2 for injecting a fuel 4, for example fuel gas and/or fuel oil, and carrier air over an injection plane 5 which is perpendicular to the channel longitudinal axis 6. Flute VG or lobes version are preferable.

The flow channel 1 and the lance 3 define a vortex generation zone 7 which is upstream of the injection plane 5. Within the vortex generation zone 7 vortex generator 8 are arranged at the inner wall of the flow channel 1 to introduce swirls into the hot gas flow 2 entering the reheat burner. Downstream in flow direction (see arrow 2 in FIG. 1) of the injection plane 5 a mixing zone 9 is connected along which the injected fuel 4 into the hot gas flow shall be mixed as completely as possible. To enhance the mixing process the shape of the inner wall of the flow channel 2 in the region of the mixing zone 9 is modified inventively. A step (not shown) in cross section of the flow channel 1 is arranged at the downstream end of the mixing zone 9 between the mixing zone and the combustor. The step is a flame holder for the flame (combustion zone). According to the present invention, there is a reshaping of the mixing zone 9, that means of the part of the hot gas channel between the fuel injection and the flame.

In a first inventive manner the flow channel 1 within the mixing zone 9 has different cross sectional areas along its longitudinal axis 6 with continuously changing shape. For better understanding of this inventive action FIG. 1 shows a circular cross section area shape $CSAS_{first}$ at the flow entrance of the mixing zone 9 which is in or close to the injection plane 5. The circular shape varies smoothly downstream along the entire mixing zone 8 when reaching a cross sectional area shape $CSAS_{last}$ at the downstream end of the mixing zone 9 having an arbitrarily cross sectional area shape.

Due to the smooth reshaping of the cross sectional areas of the mixing zone an additional shear stress to the flow 2 passing the mixing zone is introduced which creates large scale flow structures and enhances turbulences within the mixing zone. This improves the mixing performance, which leads to a more, homogeneous temperature distribution inside the flame (not illustrated) which forms by auto ignition downstream the mixing zone 9.

Figure 2A:
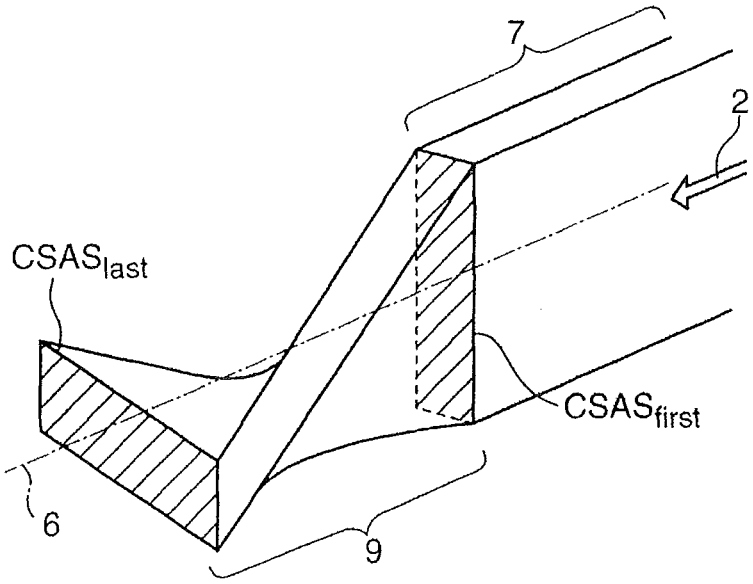

The same effect of introducing additional shear stress into the flow 2 is also achieved with a mixing zone having a given cross sectional shape which is rotated along the longitudinal axis of the mixing zone. Such action is illustrated in FIG. 2*a*. FIG. 2*a* shows the exterior of a reheat burner, which is roughly illustrated, having a rectangular cross section along its vortex generation zone 7. The cross section area shape $CSAS_{first}$ at the flow entrance of the mixing zone 9 is rectangular in an upright position relative to the longitudinal axis 6 of the reheat burner arrangement. The cross section area shape of the flow channel of the mixing zone 7 remains rectangular along its entire extension but the orientation of the cross sectional shape rotates around the longitudinal axis 6 e.g. by 90°. So the cross sectional area shape $CSAS_{last}$ at the downstream end of the mixing zone 9 has a cross wise orientation relating to the cross sectional area $CSAS_{first}$ at the upstream end of the mixing zone 9.

Figure 2B:
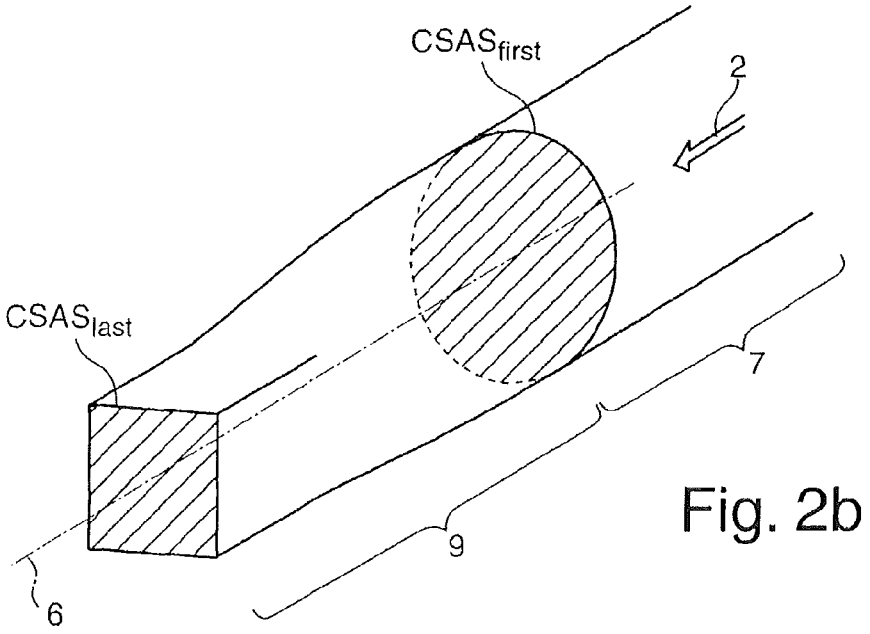

FIG. 2*b* shows the exterior of a reheat burner having a circular cross section along its vortex generation zone 7. The cross section area shape $CSAS_{first}$ at the flow entrance of the mixing zone 9 is circular. The cross section area shape of the flow channel of the mixing zone 7 changes in direction of the flow 2 from square to circular smoothly which is a preferred version. So the cross sectional area shape $CSAS_{last}$ at the downstream end of the mixing zone 9 has a circular shape and additionally the area size is furthermore reduced compared to the surface size of $CSAS_{first}$.

Figure 2C:
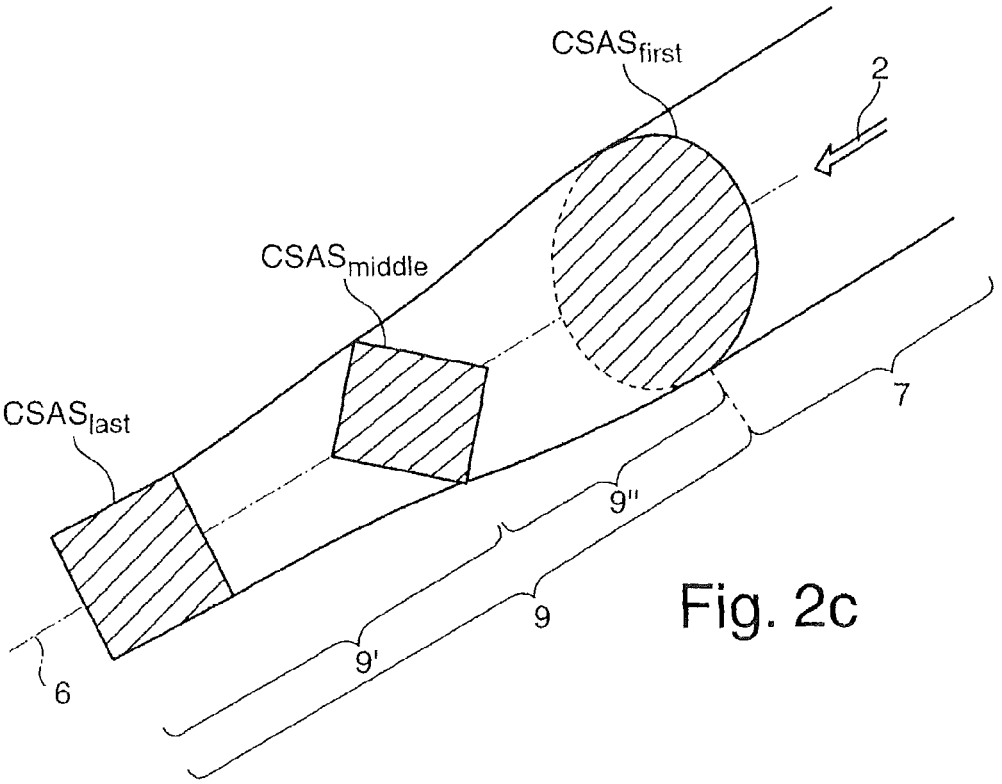
Figure 3:
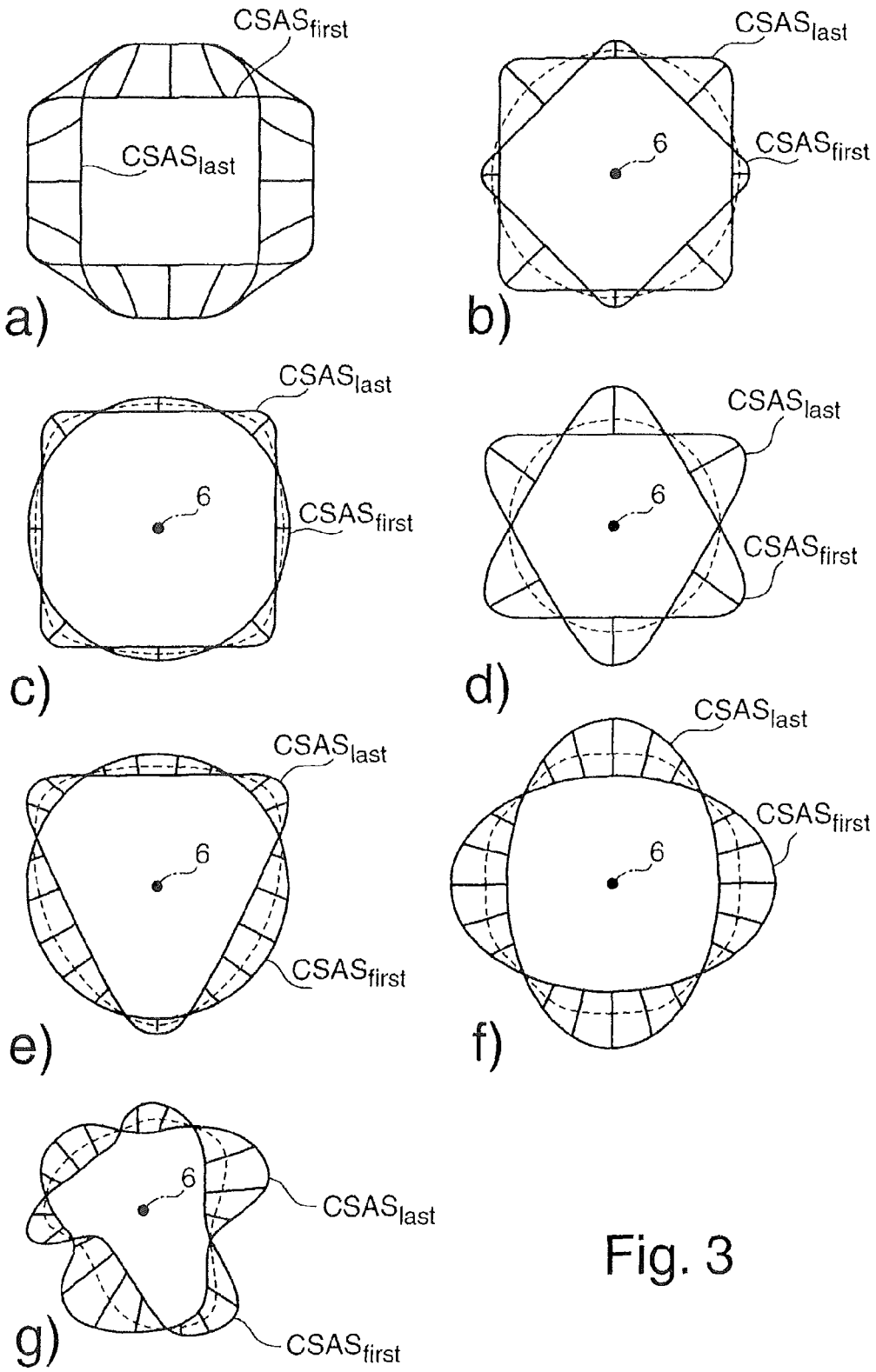
FIG. 3*a-g* possible reshaping variants of the cross section area of a mixing zone and FIG. 4 rotation of the cross sectional area along the mixing zone having a square cross section shape.

FIG. 2*c* shows the exterior of a reheat burner having a circular cross section along its vortex generation zone 7. The cross section area shape $CSAS_{first}$ at the flow entrance of the mixing zone 9 is circular. The cross section area shape of the flow channel of the mixing zone 7 changes in direction of the flow 2 from circular to square smoothly. So the cross sectional area shape $CSAS_{middle}$ at the downstream end of a first axially region 9" of the mixing zone 9 has a square shape and additionally the area size is furthermore reduced compared to the surface size of $CSAS_{first}$. In immediate connection a second axially region 9' closes to the first axially region (9") having a constant square cross section area shape which changes location along its longitudinal axis (6) by continuously rotation around the longitudinal axis (6). In the illustrated case the last cross section area shape $CSAS_{last}$ is rotated by 45° around the longitudinal axis (6) relative to the intermediate cross section area shape $CSAS_{middle}$.

FIGS. 3*a* to *g* illustrate (non-limited) possible variants of the flow channel design of the mixing zone with different combinations of the first and last cross section shapes $CSAS_{first}$, $CSAS_{last}$. Each sketch in FIG. 3 is a schematically axial view along the longitudinal axis 6.

Here all of these are reshaped instead of rotated. Of course rotation would be an option here as well.

The embodiments shown in FIGS. 3*a* to *g* illustrate reshaping of the cross sectional area shape of the mixing zone. FIG. 3*c* shows a transformation from a circular cross sectional area shape $CSAS_{first}$ into a square cross sectional area shape $CSAS_{last}$. FIG. 3*e* shows a transformation from a triangle cross sectional area shape $CSAS_{first}$ into a circular cross area shape $CSAS_{last}$ and FIG. 3*g* shows an arbitrary free cross sectional area shape in another arbitrary free cross sectional area shape.

Figure 4:
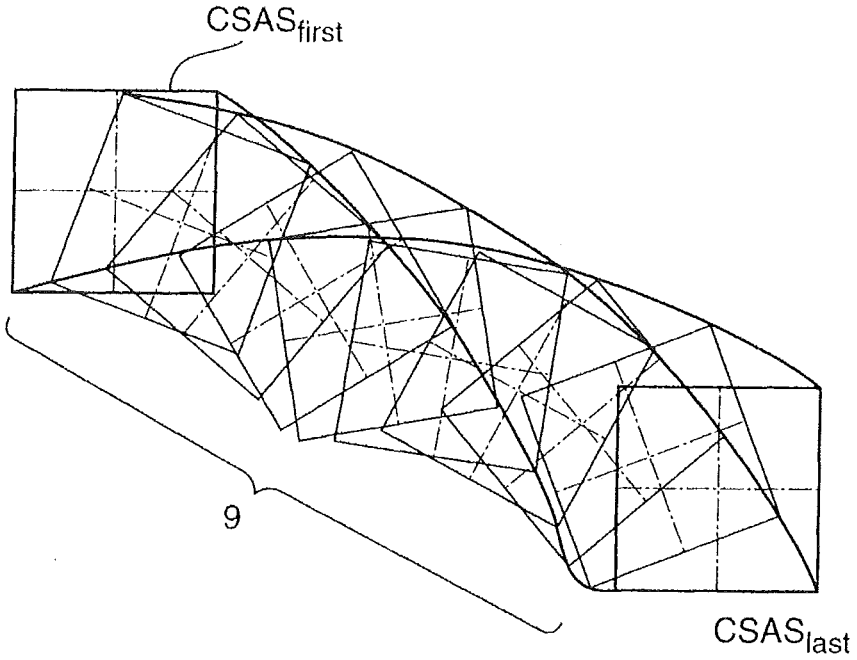

The illustration shown in FIG. 4 shall a clarify the principal of rotation of a given cross sectional shape along the mixing zone 9 showing a sequence of a multitude rotated square cross sectional areas starting with the first cross sectional area shape $CSAS_{first}$ turning into the last cross sectional area shape $CSAS_{last}$. All cross section area between $CSAS_{first}$ and $CSAS_{last}$ are intermediate cross section areas along the mixing zone 9.

What is claimed is:

1. A reheat burner between a high pressure turbine and a low pressure turbine comprising:

a flow channel for a hot gas flow with a lance arranged along said flow channel, protruding into the flow channel for injecting a fuel over an injection plane perpendicular to a channel longitudinal axis, wherein the flow channel and lance define a vortex generation zone upstream of the injection plane and a mixing zone downstream of the injection plane in the hot gas flow direction, the mixing zone including changing cross sectional areas by continuous rotation of a non-circular cross section area shape along the longitudinal axis of the mixing zone starting at a first non-circular cross section area shape and ending at an inlet of the low pressure turbine with a non-circular last cross section area shape rotated by an angle between 0 and 180 degrees around the channel longitudinal axis.

2. The reheat burner of claim 1 wherein the flow channel encircles the mixing zone with an inner channel wall, which is smooth without any protrusions extending beyond the inner wall surface.

3. A stationary gas turbine using sequential combustion having a reheat combustor that is equipped with a reheat burner according to claim 1.

4. A reheat burner comprising:

a flow channel for a hot gas flow with a lance arranged along said flow channel, protruding into the flow channel for injecting a fuel over an injection plane perpendicular to a channel longitudinal axis, wherein the flow channel and lance define a vortex generation zone upstream of the injection plane and a mixing zone downstream of the injection plane in the hot gas flow direction, the mixing zone a) having different cross sectional areas along a longitudinal axis of the mixing zone with continuously changing shape, or b) having non circular cross section areas which change location along the longitudinal axis of the mixing zone by continuously rotation around the longitudinal axis, wherein the mixing zone provides at least two axially regions with a first axially region having the different cross sectional areas along the longitudinal axis of the mixing zone with continuously changing shape, and a second axially region having the non-circular cross section area which changes location along the longitudinal axis by continuously rotation around the longitudinal axis.

5. The reheat burner of claim 4, wherein the first and second axially regions are related axially directly or indirectly.

6. The reheat burner of claim 4, wherein the cross sectional area of an upstream end of the mixing zone is greater than the cross sectional area of a downstream end of the mixing zone.

7. The reheat burner of claim 4, wherein the cross sectional area of a downstream end of the mixing zone is greater than the cross sectional area of an upstream end of the mixing zone.

8. A method for mixing a fuel and a carrier air flow within a reheat burner between a high pressure turbine and a low pressure turbine, in which the carrier air flow enters the reheat burner and being swirled by vortex generators inside the reheat burner before fuel is injected into the carrier air flow and producing a flow of fuel/carrier air mixture by injecting fuel into the swirled carrier air flow comprising:

propagating of said flow of fuel/carrier air mixture along a flow channel downstream to said fuel injection; and introducing shear stress to the flow of fuel/carrier air by passing the flow of fuel/carrier air through a mixing zone of the flow channel, the mixing zone extending downstream from an injection plane perpendicular to a longitudinal axis of the flow channel, the mixing zone including changing cross sectional areas by continuous rotation of a non-circular cross section area shape along the longitudinal axis of the mixing zone starting at a first non-circular cross section area shape and ending at an inlet of a low pressure turbine with a non-circular last cross section area shape rotated by an angle between 0 and 180 degrees around the longitudinal axis.

9. A method for mixing a fuel and a carrier air flow within a reheat burner, in which the carrier air flow enters the reheat burner and being swirled by vortex generators inside the reheat burner before fuel is injected into the carrier air flow and producing a flow of fuel/carrier air mixture by injecting fuel into the swirled carrier air flow comprising:

propagating of said flow of fuel/carrier air mixture along a flow channel downstream to said fuel injection; and introducing shear stress to the flow of fuel/carrier air by passing the flow of fuel/carrier air through a mixing zone of the flow channel, the mixing zone extending downstream from an injection plane perpendicular to a longitudinal axis of the flow channel, the mixing zone a) having different cross sectional areas along a longitudinal axis of the mixing zone with continuously changing shape, or b) having non circular cross section areas which change location along the longitudinal axis of the mixing zone by continuously rotation around the longitudinal axis, and wherein the mixing zone provides at least two axially regions with a first axially region having the different cross sectional areas along the longitudinal axis of the mixing zone with continuously changing shape, and a second axially region having the non-circular cross section area which changes location along the longitudinal axis by continuously rotation around the longitudinal axis.

10. The method of claim 9, wherein the first and second axially regions are related axially directly or indirectly.

11. The method of claim 9, wherein the cross sectional area of an upstream end of the mixing zone is greater than the cross sectional area of a downstream end of the mixing zone.

12. The method of claim 9, wherein the cross sectional area of a downstream end of the mixing zone is greater than the cross sectional area of an upstream end of the mixing zone.

* * * * *